US010757987B2

(12) United States Patent
Pratson

(10) Patent No.: US 10,757,987 B2
(45) Date of Patent: Sep. 1, 2020

(54) KNEE PAD DEVICE

(71) Applicant: David Pratson, Bonsall, CA (US)

(72) Inventor: David Pratson, Bonsall, CA (US)

( * ) Notice: Subject to any disclaimer, the term of this patent is extended or adjusted under 35 U.S.C. 154(b) by 91 days.

(21) Appl. No.: 15/871,882

(22) Filed: Jan. 15, 2018

(65) Prior Publication Data

US 2018/0132549 A1 May 17, 2018

Related U.S. Application Data

(63) Continuation-in-part of application No. 14/221,090, filed on Mar. 20, 2014, now Pat. No. 9,867,408.

(60) Provisional application No. 61/803,738, filed on Mar. 20, 2013.

(51) Int. Cl.
*A41D 13/06* (2006.01)
*A41D 13/015* (2006.01)

(52) U.S. Cl.
CPC ..... *A41D 13/065* (2013.01); *A41D 13/0158* (2013.01); *A41D 2600/20* (2013.01)

(58) Field of Classification Search
CPC ..... A41D 13/065
See application file for complete search history.

(56) References Cited

U.S. PATENT DOCUMENTS 5,455,969 A * 10/1995 Pratson ..... A41D 13/0568 2/24
5,727,252 A * 3/1998 Oetting ..... A41D 13/0562 2/24
9,867,408 B2 * 1/2018 Pratson ..... A41D 13/065
2009/0126066 A1 * 5/2009 Sasaki ..... A41D 13/0568 2/24
2013/0007938 A1 * 1/2013 LoCicero ..... A41D 13/06 2/24
2013/0145514 A1 * 6/2013 Noble ..... A41D 13/065 2/24
2014/0283275 A1 * 9/2014 Pratson ..... A41D 13/065 2/24

* cited by examiner

*Primary Examiner* — Khaled Annis
(74) *Attorney, Agent, or Firm* — Donn K. Harms

(57) ABSTRACT

A knee pad for engagement to a user in an as-worn position with a cavity defined by an interior surface surrounding a knee of a user. A plurality of projections extend from the body of the knee pad and are made of compressible material to provide a cushioned support to the knees and prevent rolling of the knee pad during use.

7 Claims, 7 Drawing Sheets

KNEE PAD DEVICE

This application is a Continuation-in-Part application to U.S. patent application Ser. No. 14/221,090, filed on Mar. 20, 2014 now U.S. Pat. No. 9,867,408 which claims priority to U.S. Provisional Patent application Ser. No. 61/803,738 filed on Mar. 20, 2013, both of which are incorporated herein in its entirety by this reference thereto.

BACKGROUND OF THE INVENTION

1. Field of the Invention

The present invention relates generally to knee pads and knee protection devices. More particularly, the invention relates to a knee pad device for both protecting the user's knees from injury and concurrently improving user stability when in a kneeled or knee support position, comprising means for communicating the user's weight to a plurality of contact surfaces.

In addition to providing the knees a shield to impact and puncture injury, the device herein also includes a plurality of contact surfaces which are preferably co-planarly aligned. In use with these surfaces the device provides significantly improved stability by distributing the weight throughout the plurality of contact surfaces over a wide footprint. The invention also relates to a knee protective device employing means for shock absorbency for reducing fatigue by reducing the perceived weight communicated to the user's knee as experienced by the user during prolonged knee supported positions. Additionally, the invention relates to the employment of slip resistance means with knee pad devices for reducing slip between the contact surfaces and the support surface for improving safety. Further, the device may be configured with removable engagement means for the various components to facilitate replacement as needed.

2. Prior Art

Knee pads and knee protection devices are a type of protective equipment which are typically worn around the leg at the knee, or strapped directly to the knee. Generally, such devices provide some sort of knee protection and support depending on the venue of employment. In a sports venue, knee pads are conventionally worn to protect the athlete against impact injury related to a fall or side-strike by an opponent. In another example, in some extreme sports such as skateboarding and inline skating, knee pads are worn by the athletes to protect their knee from impact and abrasive injuries from ground contact after a fall. In another mode of use such as with construction, knee pads can be worn to provide padding to the skin and underlying bones during extending periods of kneeling, as well as protection form injury when kneeling in nail-laden construction sites.

For the latter, it is well known that construction workers and other labor professionals are often required to work on their knees for long periods. For example, workers who install floor coverings are often required to maintain a kneeling position for hours of time during the preparation and subsequent installation of a floor covering in a room. Maintaining this position while performing labor-intensive installation can be extremely uncomfortable.

Kneeling workers often experience knee injuries caused by maintaining such a position for prolonged periods. Further, users are additionally known to experience both back and neck injuries due to the user constantly straining to lean or work adjacently while concurrently trying to keep excess pressure off their knees and maintain a comfortable working position while on their knees. As such, many individuals who perform this work will wear some type of knee pad device which provides some padding to reduce the stresses on the skin and bones of their knees which is experienced during such prolonged periods of kneeling. As a result of being able to place more weight on padded knees, users tend to experience less back and neck pain since the support and comfort at their knees allows them to maintain an overall comfortable working position and more proper posture during extension.

However, currently available conventional knee pads and support devices intended to support the knee during extended periods of kneeling still fail significantly in many aspects. Many conventional knee pads and knee protection devices provide some type of support and protection when in a stationary kneeling position. However, many do not take into account that the user may be constantly moving their upper body in differing leaning directions over the contact of their knees with the supporting surface while performing various tasks in the kneeled position. If a user leans or reaches for an item, lifts or moves items while kneeling, or shifts their upper body frequently, the weight distributed to each knee, and therefor to each knee pad in contact with a support surface, will change constantly. With conventional devices, this transfer of weight from one pad to the other can cause many problems.

First, many knee pads and related devices have substantially rounded exterior surfaces, since the pad as a whole is generally designed to conform with the natural curvature of the human knee when worn. In use, the curved exterior surface of the pad devices, when in contact with a support surface, provides only a single contact surface area per pad. Although some conventional devices are known to have flexible surface materials capable of slightly flattening during contact with the support surface, to slightly increase the surface area of contact, such pads have a substantially smooth plastic surface and still only a single contact surface area per pad is provided.

As such, many conventional knee pad devices are inherently unstable. The knee pad devices can rock and sway about the singular contact point and if the user leans too far in one direction the smooth surface of the conventional pads can slip in their frictional engagement with the support surface. The curved exterior surface makes it extremely difficult for the user to maintain a stable kneeling position as the pads will tend to rock along the curved and limited exterior contact surface area and will cause discomfort at the knee. This is especially true when the user's upper body is moving and the distribution of weight is constantly changing.

Further, in leaning to one side or the other, or if the user become slightly unbalanced for any reason, one or both knee pads may lift from their contact engagement with the support surface and one or both may possibly slip. This problem of sideways slip is enhanced if the support surface is slick or wet. Any such slipping instance can cause the user to fall, or drop an item and potentially cause injury to themself or others.

Still further, knee pads which are used on a daily basis often become worn and unusable after some time due to conventional wear and tear. This wear and tear especially includes the exterior surface, which is used for frictional and contact stability with the support surface, becoming worn or scratched to the point where the device cannot adequately engage a support surface without slipping. In addition, any padding or other support material may become worn such that the device is no longer comfortable in its engagement to the user's knee. This conventionally results in the user discarding the worn knee pads and purchasing knew ones. Such actions are quite wasteful, since in most cases the structural body of the knee pad may be fully intact and suitably usable, while it is merely exterior surfaces or padding which are worn to render it unsafe and/or uncomfortable As a result, there is a continuing unmet need for a knee pad device which provides improved stability, and improved slip resisting support to the user during use. Such a device should overcome the shortfalls in prior art and improve user stability by communicating the downward force of the user's weight to a plurality of contact surfaces, as opposed to a single contact surface. Such a plurality of contact surfaces should advantageously should follow the curve or shape of the exterior of the knee pad to provide a planar or full contact footprint area of engagement with the support surface which eliminates rocking or swaying of the device when supported on the support surface. Such a device should employ one or a plurality of pad components to comfortably cushion the user's knee when compressed by their weight toward the support surface. Such a knee pad device should employ means for shock absorbency for reducing user fatigue by reducing the perceived weight communicated to the user's knee as experienced during prolonged knee support. Such a device should employ means for slip resistance for reducing slip between the contact surfaces and the support surface for improving safety. Further, such a device should be configured with means for removable engagement of the various components to facilitate easy replacement after they become worn, and thereby reduce the amount of such devices sent to landfills.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art and achieves the above noted goals through the provision of a knee pad device for improving user stability when in a kneeled or knee support position over prolonged periods of time. It accomplishes this goal by communicating the force of the user's weight to a plurality of contact surfaces with the support surface instead of one. The device is preferably configured with means for removable engagement of many of its key components as needed to facilitate replacement after they become worn and unusable.

In accordance with a first preferred, and simplest mode, the device comprises a body having a circumferential side edge communicating between an exterior surface and an interior surface. The interior surface is preferably adapted for a comfortable engagement to a user's knee in shape and material, while the exterior surface is adapted for an engagement with the ground or other support surface. Means for operative engagement of the device to a user's knee can include one or a plurality of elongated engagement straps which can be wrapped around the leg at or adjacent the user's knee, or on the parts of the user's leg slightly above and below the knee. The straps may employ hook and loop fasteners, snaps, or other suitable fastening means for their respective distal ends and may be elastic to provide a means to bias the knee pad toward the user's knee. Such should allow the body of the device to be securely engaged to the user's knee once the desired tightness, and/or stretching of the straps are achieved.

The exterior surface of the body of the device, preferably employs means for communicating the force of the user's weight to a plurality of contact surfaces herein provided by a plurality of stabilizing projections engaged to and extending from the exterior surface. The projections are preferably in the form of elongated strips aligned in a central position on the exterior of the body. T In one preferred mode, the distal ends of the projections include raised ends defining a central hollow channel which spaces the ends a distance apart. The raised ends preferably have at least one contact surface which is substantially planar.

The plurality of planar contact surfaces of the projections are preferably co-planarly aligned and define an overall footprint area of the device when engaged on a support surface. The area of the footprint is defined by the number and spacing of the projections comprising an overall length, multiplied by a width determined by the distance of the channel. It is noted that the size of the contact footprint area can vary by employing projections of various dimensions as deemed suitable by the designer to provide improved user stability.

As such, the co-planarly aligned flat contact surfaces of the projections provides a means for communicating and distributing the user's weight over a plurality of contact surfaces over the desired stabilizing footprint area. In addition, the provision of the plurality of planar contact surfaces when engaged to the support surface, provide an engagement which is inherently resistant to rocking and swaying due to the plural points of engagement with the support surface.

The plural points of engagement provided by the co-planar surfaces maintain improved stable support even when the user reaches for an item, lifts or moves items in their workspace, or moves their upper body frequently. In use, the weight communicated to each knee and therefor to each knee pad device is continually distributed throughout the plurality of contact surfaces on the projections. For example, in an extreme case where the user leans to the point where some of the contact surfaces are lifted off of the support surface, the remaining contact surfaces still in contact with the support surface will continue to distribute the weight such that stable support is maintained. Further, in all modes, the material employed is compressive or elastic and provides a means for padding the knees and their force toward the support surface.

In at least one preferred mode, the body is formed from planar material which is bent or otherwise constructed to conform to the shape of the human knee, and slightly or moderately wrap around the knee when in the as worn position. The device may be formed from conventional plastics via conventional forming techniques such as injection molding, or other suitable forming means.

It is noted those skilled in the art may envision additional or modified shapes and configurations of the body, as well as other means for communicating the user's weight to a plurality of contact surfaces which are suitable for the intended purpose of reducing rock and sway of the device in the as worn position. As such, other embodiments envisioned by those skilled in the art are anticipated in this disclosure while the descriptions and depictions in the figures provided herein should not be considered limiting in any manner.

In another preferred mode, the device employs a pad component engageable to the interior surface of the body. In use, the pad component will be in a sandwiched engagement between the body of the device and the user's knee when worn to provide support and cushioning comfort for the user's knee. The pad component is preferably ergonomically shaped and substantially formed to the shape of the human knee to provide the utmost comfort since users may have to maintain a kneeled position for long periods of time. Further, the pad is compressive or elastic and preferably includes air cooling means, provided by one or a plurality of air vent channels communicating with vent apertures to communicate air through the pad to the user's knee for cooling applications.

In still another preferred mode, the device may include an upper component engaged to the body of the device which is intended to engage the user thigh, just above the knee. The upper component preferably engages over the user's thigh to provide a protective barrier for it. It is known that users who work on their knees typically have a work space in front of them and conventional knee pads do not cover a large area of the thigh.

As such the thigh may be exposed to inadvertent injury during use of power tools, hand tools, welding or other equipment used in the workspace. Additional utility is provided through the employment of a sealing strap, which communicates over an upper terminating edge of the upper component to provide a sealed engagement of the upper component against the user's thigh. This provides a means for preventing sparks or slag during welding, or other debris from lodging between the upper component and the user's thigh.

Further, due to the typically labor intensive work associated with users who work on their knees, as noted means for shock absorbency for reducing user fatigue, are additionally preferably provided. Means for shock absorbency will essentially reduce the perceived weight communicated to the user's knee when the users moves around or shifts their weight during a prolonged knee support position.

In at least one mode, the means for shock absorbency is provided by forming the raised ends of the stabilizing projections with a material and construction which is adapted with slight or moderate compression and rebound characteristics. For example, a resilient rubber or similar material such as ABSORBATHANE which will compress under the weight of the user and absorb impact forces when the device contacts the ground may be suitable for this purpose. However, other embodiments envisioned by those skilled in the art which serve the intended purpose may also be employed, and are anticipated.

In yet another mode, means for slip resistance between the contact surfaces of the device and the support surface are additionally provided. This may be provided through the employment of friction enhancing contact surface materials. For example, the flat planar contact surfaces of the projections may be configured with a friction enhancing material, such as a soft rubber or the like, which is imbedded into the contact surfaces in a 2-shot injection molding process when forming the projections using conventional injection molding techniques. However, other embodiments envisioned by those skilled in the art which serve the intended purpose of reducing slip may also be employed, and are anticipated.

In still another preferred mode, the device is configured with means for removable engagement of at least one of the plurality of stabilizing projections and the pad component, as needed to facilitate replacement after they become worn and unusable. As such, in this mode the device may be providable to the user in a kit mode, including the body of the device, the upper component, one or a plurality of engagement straps, one or a plurality of removably engageable padding components, and one or a plurality of removably engageable stabilizing projections. The kit may include various constructions of the stabilizing projections and padding components, each formed of different durometer or hardness of materials which provide different friction enhancing and shock absorbency characteristics, and comfort level deemed suitable by the user. In addition, the projections can be provided having different geometries thereby allowing the user to vary the size of the footprint as needed. As such a plurality of stabilizing projections and pad components can be provided as replacements.

It is briefly noted that upon reading this disclosure, those skilled in the art will recognize various means for carrying out these intended features of the invention. As such it is to be understood that other devices may be configured to carry out these features and are therefor considered to be within the scope and intent of the present invention, and are anticipated.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects, features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

Figure 1:
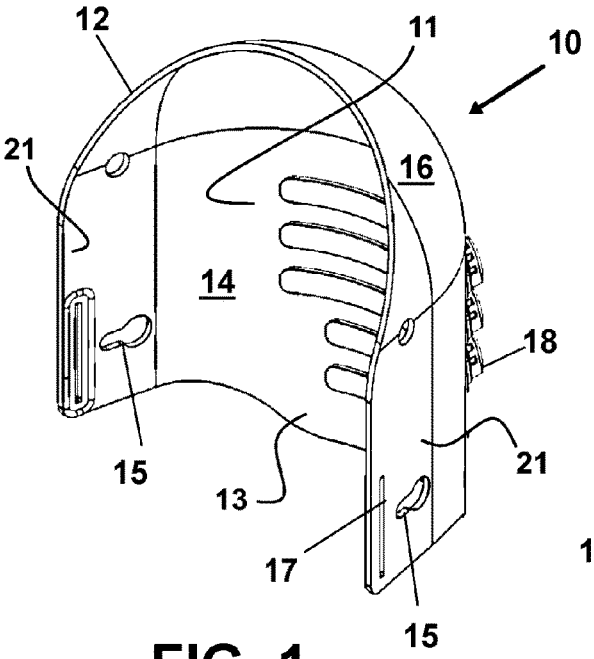
FIG. 1 shows a rear perspective view of a particularly preferred mode of the knee pad device comprising a device body employing a plurality of stabilizing projections.
Figure 2:
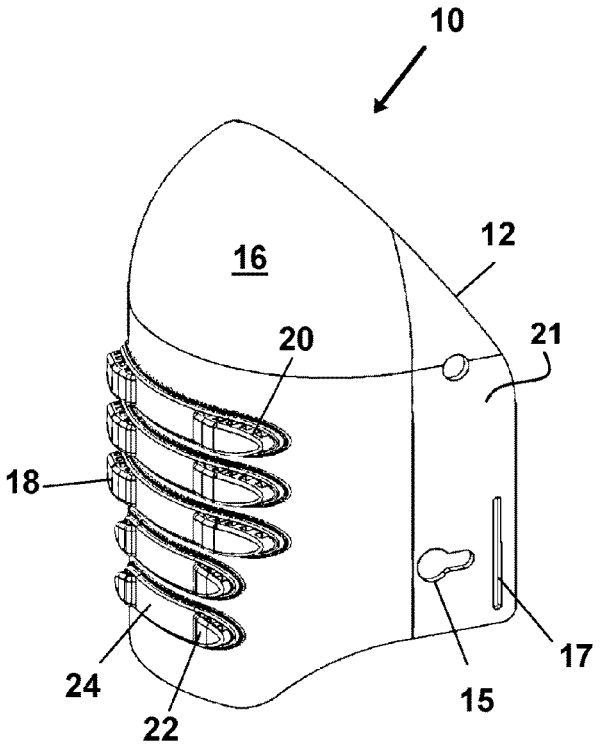
FIG. 2 shows a front perspective view of the mode of the device of FIG. 1.
Figure 3:
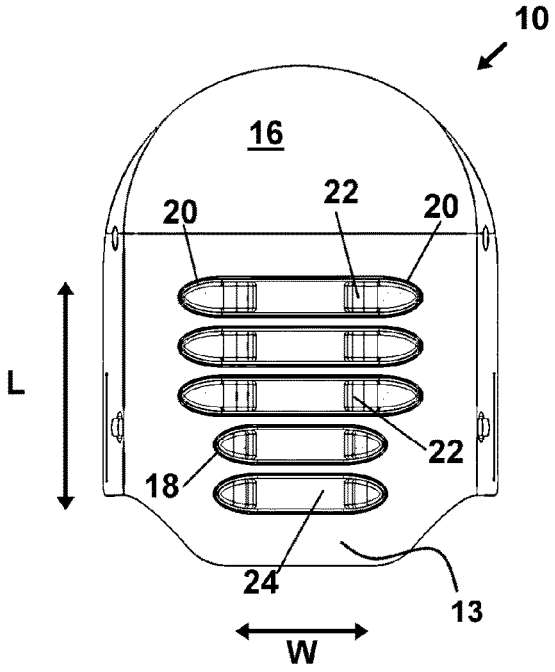
FIG. 3 shows a front view of the mode of the device of FIG. 1.
Figure 4:
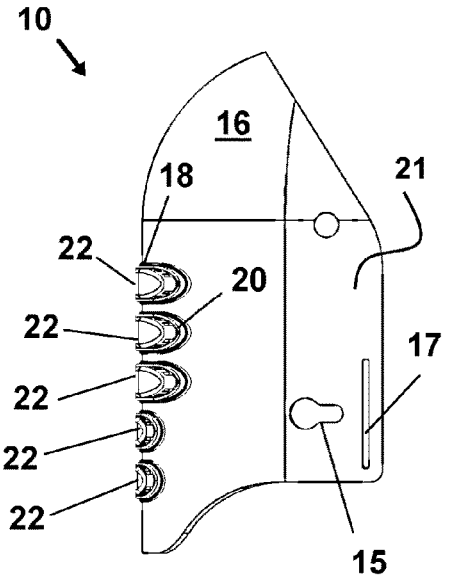
FIG. 4 shows a side view of the device of FIG. 1.

Other aspects of the present invention shall be more readily understood when considered in conjunction with the accompanying drawings, and the following detailed description, neither of which should be considered limiting.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Now referring to drawings in FIGS. 1-18, wherein similar components are identified by like reference numerals, there is seen in FIGS. 1-4, views of a particularly preferred mode of the knee pad device 10 herein for improving user stability and comfort when in a kneeled or knee supported position over prolonged periods of time. As can be seen with the device 10 operatively engaged, communication of force of the user's weight is made to a plurality of contact surfaces 22 on opposing sides of a channel 24 which is recessed between the contact surfaces 22 of opposing raised ends 20 on the plurality of projections 18.

In accordance with this mode shown in the noted figures, the device 10 includes a body 12 being a substantially thin shell having a circumferential side edge defining a shape and communicating between a interior surface 14 and an exterior surface 16. The various components of the body 12 of device 10 disclosed herein can be formed of conventional materials such as synthetic materials like carbon fiber, plastics such as PVC, ABS, or polypropylene or other rigid materials adapted to the task. However, the body 12 and the upper component 30 can be formed of any material suitable for the purposes set forth in this disclosure.

A curved exterior surface 16 of the body 12 extends across a central portion 13 of the body 12 and along two side portions 21 of the body 12 on opposite sides of the central portion 13. In the current mode, the body 12 is constructed to conform to the curved shape of the human knee, and formed to slightly or moderately wrap around the exterior of the knee when in the as-worn position with the knee in contact with or adjacent the interior surface 14 with straps engaged. The curved interior surface 14 extends across the central portion 13 of the body 12 and along the two side portions 21 of the body 12 and defines a cavity 11 which is adapted for an as-worn engagement with a user's knee positioned therein adjacent the interior surface 14 in manner similar to conventional knee pad devices for providing knee support when in a kneeled or knee supported position.

Figure 8:
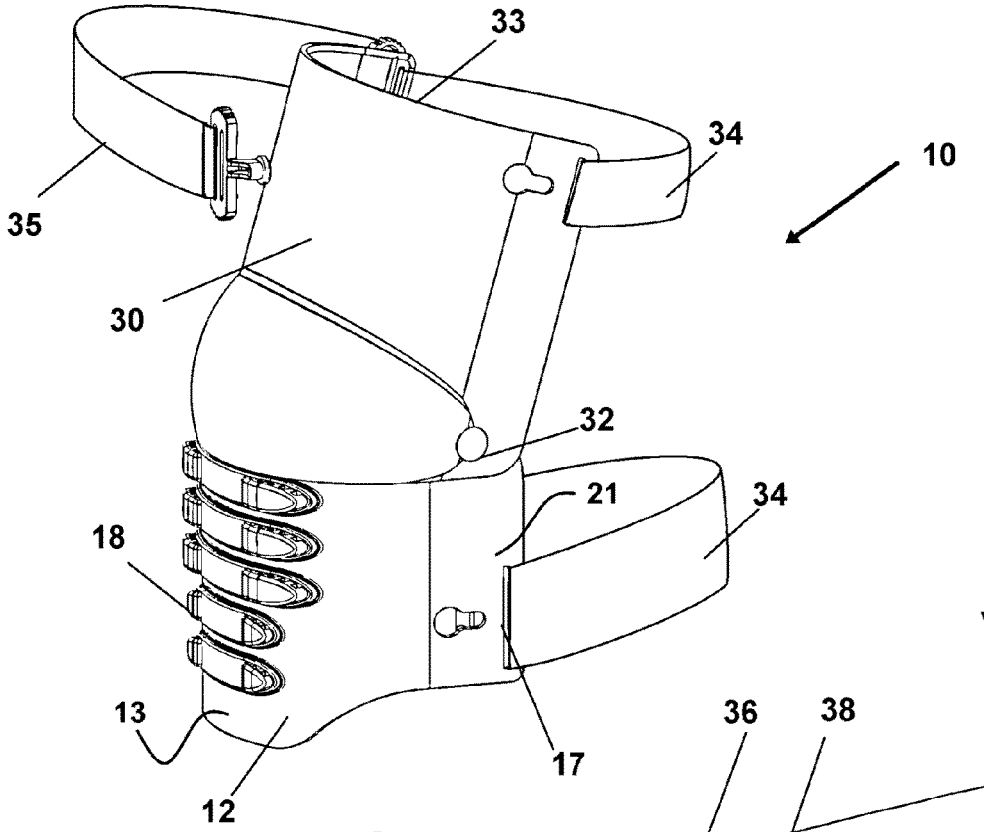
FIG. 8 shows a first side perspective view of the yet another mode of the device comprising a rotatably engageable upper component. As shown is a preferred sealing strap employed to engage over the upper terminating edge to keep out debris.
Figure 9:
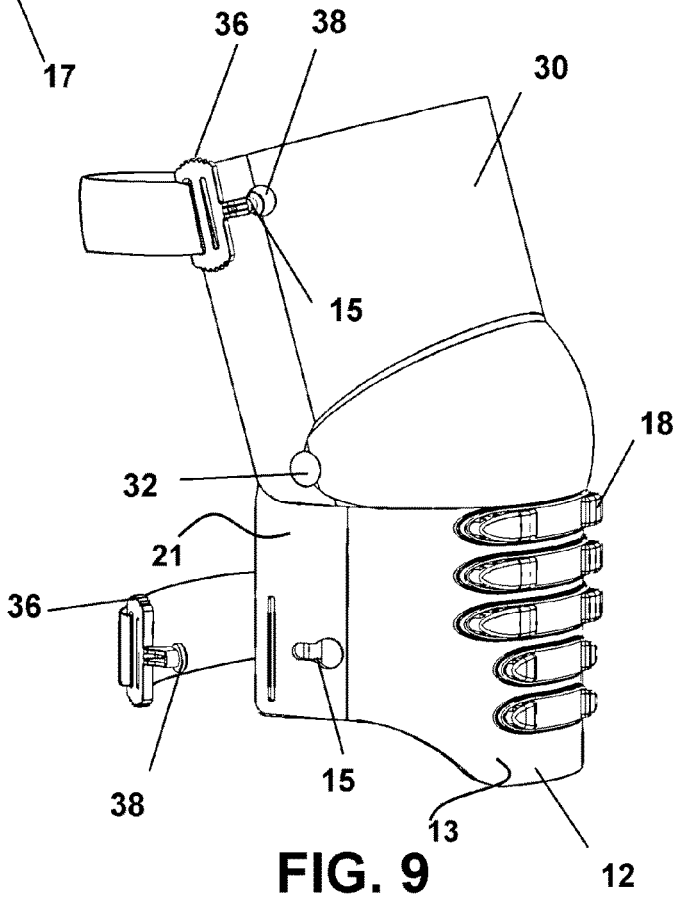
FIG. 9 shows a second side perspective view of the mode of the device of FIG. 8.

Means for maintaining engagement of the device 10 with the user's knee, within the formed cavity 11 and adjacent the interior surface 14, can include one or a plurality of elongated engagement straps 34 (FIGS. 8 and 9). These straps may be elastic or fixed in length and may be engaged around the rear of the user's knee at the knee or on the parts of the user's leg slightly above or below the knee. However, those skilled in the art may envision other means for engagement which are suitable for the intended purpose and are therefor anticipated within the scope of this disclosure. Further, in other modes the device 10 may be employed in a free-standing manner without means for engagement where instead the device 10 is placed on the floor and the user kneels into an engagement with the device 10 when needed.

The straps 34, as noted, may be elastic in whole or in part whereby they elongate and when the distal ends are engaged with two straps 34 the device 10 is biased toward the front of the user's knee.

The exterior surface 16 of the body 12 is curved similar to the interior surface 14 and preferably includes means for communicating the force of the user's weight upon the device 10 when in a kneeling position, to a plurality of contact surfaces 22. The contact surfaces 22 herein are preferably provided by one or a plurality of projections 18 engaged to and extending from the exterior surface 16. As clearly shown in the drawings, the projections 18 are preferably in the form of individual elongated strips which are aligned in a central location on the exterior 16 of the body 12. This allows individual strips to be replaced, however the projections 18 can be formed by a single unit having recesses therein to form the plurality of projections 18 at a distal end.

While the device 10 is a huge improvement in the art with the projections 18, the distal ends of the projections 18 may also preferably include shoulders depicted as raised ends 20 on opposite ends of the projections 18 which define a recess or channel 24 therebetween and where the distal end of the projection 18 may also be lower than the two shoulders or raised ends 20 similar to the lower elevation of the channel 24. The shoulders provided by the raised ends 20, preferably, have at least one contact surface 22 which is substantially planar and aligns along an imaginary line, with an opposing contact surface 22 on the projection 18 on the opposite side of the recess defined by the channel 24.

The plurality of raised ends 20 with substantially planar contact surfaces 22 located on opposing sides of the projections 18 are preferably co-planarly aligned define an overall contact footprint area of the device 10 when positioned on a support surface with the device 10 in the as-worn position. The area of the contact footprint is defined by the number and spacing of the projections 18 comprising an overall length 'L', multiplied by a width 'W' determined by the distance of the channel 24 forming the recess on the projection 18 in between the raised ends 20. It is noted that the size of the contact footprint can vary by employing projections 18 of various quantities and dimensions as deemed suitable by the designer to provide improved user stability.

The channel 24 has a length which spaces the raised ends 20 a distance apart defining the width 'W' of the contact footprint, which can be varied to essentially widen the overall area of the contact footprint for improving stability and distribution of weight to the co-planarly aligned contact surfaces 22. Therefor, the widened contact surface area and footprint providing a distribution of weight to the plurality of contact surfaces 22 provides an overall improved and stability-enhanced engagement with a support surface for a user, compared to that of conventional knee pad devices which typically provide a single contact surface which may be curved or otherwise have a substantially smaller contact footprint.

The plurality of substantially planar contact surfaces 22 on the contact surfaces 22 on opposite ends of the projections 18, aligned across respective channels 24 in a common plane, define an overall contact surface area for the device with an underlying support surface, which is highly resistant to rocking and swaying. This is due to the plurality of contact of the raised portions 20 or shoulders located on opposing sides of each recess defined by the channel 24, with the support surface. It is noted and anticipated that the distance of the channel 24 portion and therefor, spacing between the raised ends 20 and contact surfaces 22 thereon, can be modified by the designer as deemed suitable for providing a wider width 'W' and therefor a larger contact footprint area.

In addition, the plurality of points of contact via the multiple curved planar surfaces 22 on the raised portions 20, maintain improved stable support for the knee, even when the user reaches for an item, lifts or moves items in their workspace, or moves their upper body frequently. In use, the weight of the user which is communicated to each knee and therefor to each knee pad device 10 is continually distributed throughout the plurality of channels 24 and against the raised contact surfaces 22 located on the raised portions 20 on opposite sides of the projections 18. For example, in an extreme case where the user leans to the point where some of the contact surfaces 22 are lifted out of contact with the support surface, the remaining plurality of other contact surfaces 22 which are each raised above adjacent channels 24, remain in contact with the support surface and will continue to distribute the weight of the user throughout, such that rotation of the device 10 and slipping and sliding is prevented, and a stable support is maintained.

Figure 5:
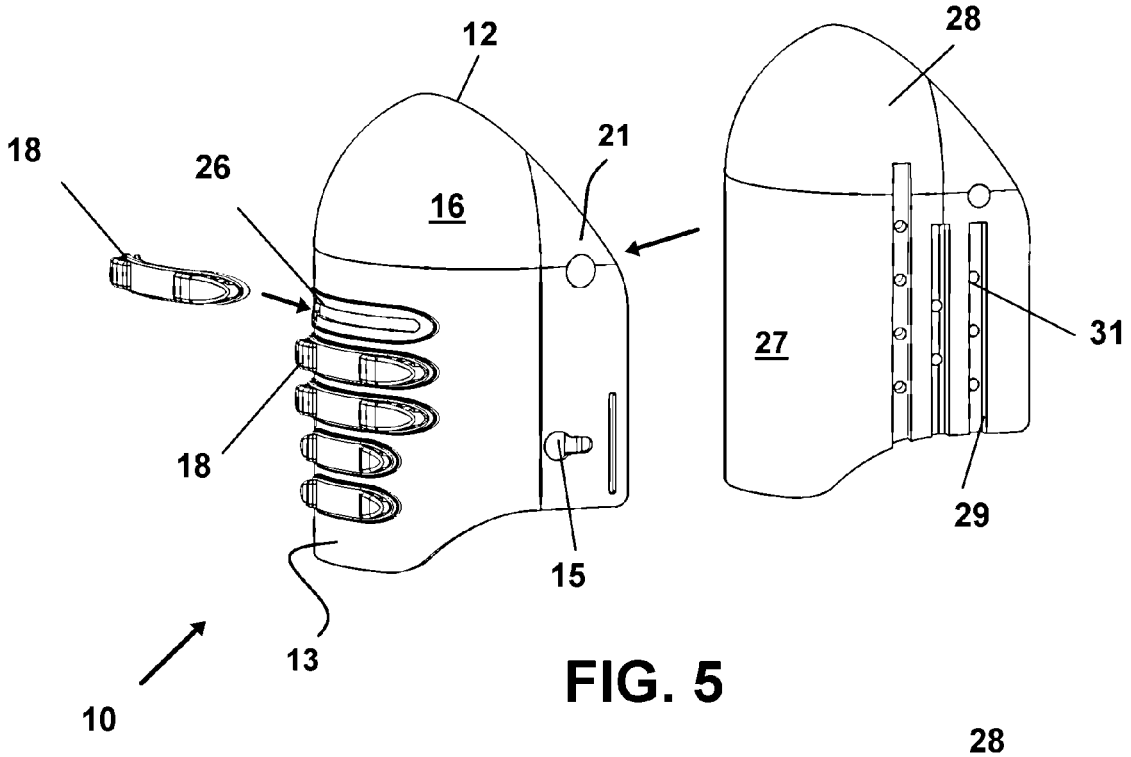
FIG. 5 shows a another particularly preferred mode of the device comprising a removably engageable padding component and means for removable engagement of the stabilizing projections.
Figure 17:
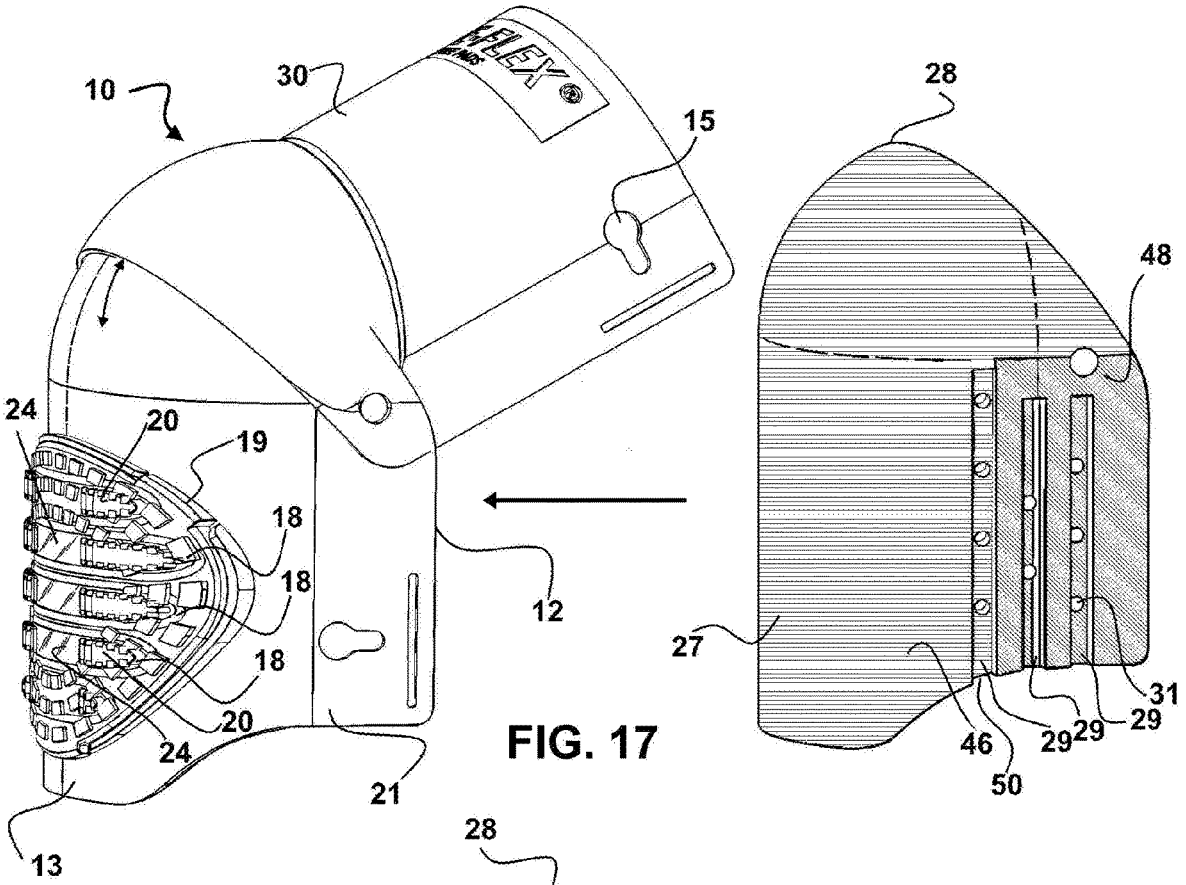
FIG. 17 depicts the device of FIG. 11-12 showing a dual density pad component having a softer more compressible foam area in a central portion located between opposing sidewalls formed of harder foam.

In another particularly preferred mode of the device 10 shown, in FIG. 5 and FIG. 17, there is included an engageable pad component 28 formed of a foam cushion or other suitable material such as ABSORBATHANE. The pad component 28 is configured for removable engagement within the cavity 11 against the interior surface 14 of the body 12 of the device 10. In use, with the device 10 in the as-worn position, the pad component 28 is in a sandwiched engagement within the cavity 11 between the interior surface 14 of the body 12 and the user's knee to thereby cushion and provide additional support and comfort for the knee of the user.

The pad component 28 is preferably configured with air cooling means, provided by one or a plurality of air vent channels 29 depending into an exterior surface 27 of the pad 28, which communicate with a plurality of vent apertures 31. The air vent apertures 31 communicate between vent channels 29 on the exterior 27 and the interior surface 37 of the pad 28. This provides a means for communicating air through the pad 28 allowing heat to escape for cooling the area of the pad 28 adjacent the interior surface 37 and thus the knee of the user. It is noted that those skilled in the art may recognize other means for air cooling which are slightly or moderately different than the preferred mode shown, however without departing from the scope and intent of the invention, are anticipated within the disclosure.

The pad component 28 is preferably ergonomically shaped as in FIGS. 4-5 and 17-18, and formed substantially to the shape of an exterior surface of a human knee to provide the upmost comfort since users may have to maintain a kneeled position for long periods of time. Means for removable engagement of the pad component 28 within the cavity 11, and positioned against the interior surface 14 of the body 12, can include hook and loop fasteners, snap fits, rivets, frictional engagement, removable adhesives, or other suitable means.

Briefly, in the kit mode of the device 10 described later in FIG. 10, such means for removable engagement allows the pad component 28 to be easily replaced as needed. However, in other modes those skilled in the art will recognize that the pad component 28 and body 12 can be integrally formed as a unitary structure, and this configuration is also anticipated.

Further, the device 10 may be configured with means for removable engagement of the stabilizing projections 18 to the exterior surface 16 of the body 12 of the device 10. This provides added utility in that the user can replace or exchange the plurality of projections 18 having channels 24 between opposing contact surfaces 22 of raised portions 20 as they become worn due to wear and tear.

Figure 10:
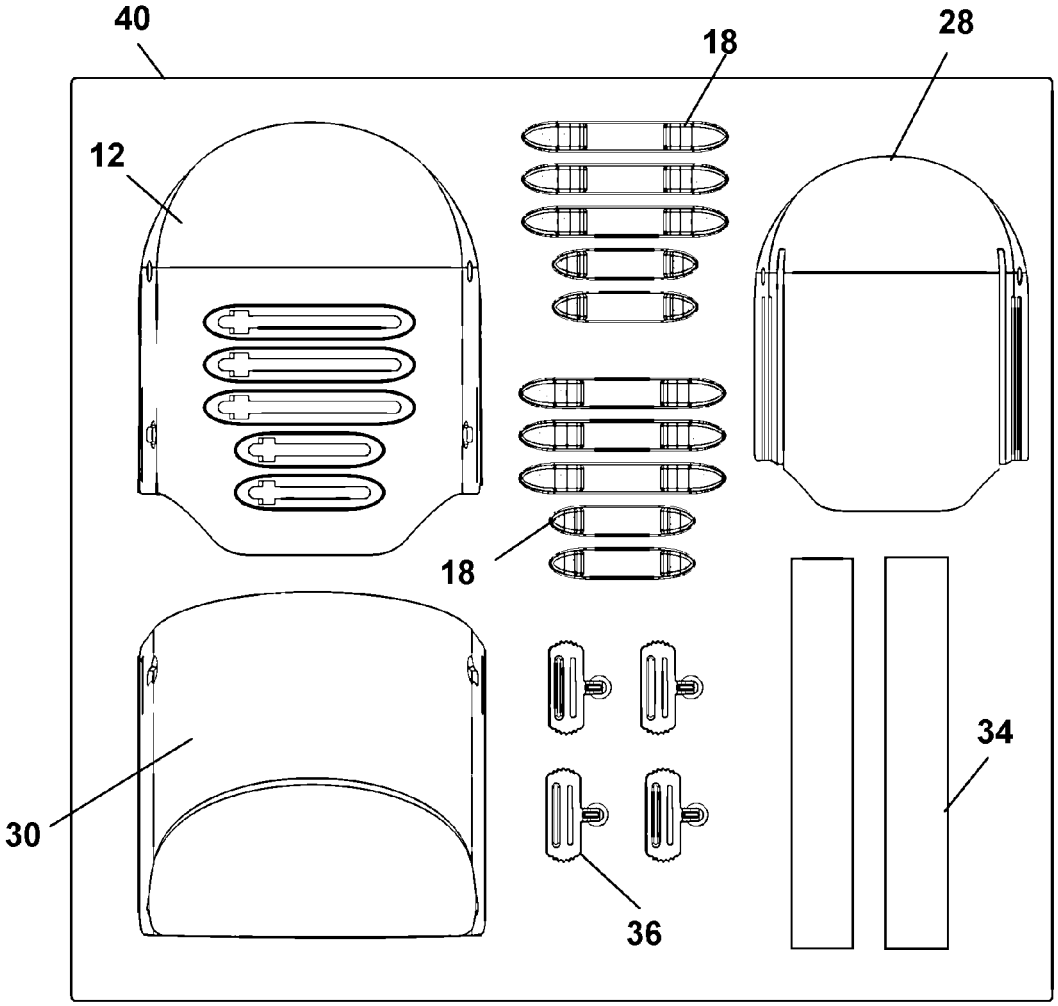
FIG. 10 shows still another particularly preferred kit mode of the device.

Additionally, the device 10 may be provided in a kit mode shown in FIG. 10, where the user is provided with a plurality of sets of projections 18 of varying durometer material, thereby allowing the user to customize the device 10 to suit their needs for compressive padding when kneeling and slip resistance when leaning. In the current mode, the means for removable engagement is provided by engagement of a first side of the projections 18 into receiving apertures 26 disposed into the body 12 of the device 10 which are adapted to removable engage with the first side of the projections. As shown, a slot provides the receiving aperture 26 which allows for a compressive engagement of the projections 18 to the body 12. However, other means for removable engagement may be employed and are anticipated, for example, hook and loop fasteners, removable adhesives, peel and stick, and the like.

Means for shock absorbency of external forces and the weight of the user against the support surface for reducing user fatigue are additionally preferably provided. Such means for shock absorbency are intended to essentially reduce the perceived weight communicated to the user's knee when the user moves around or shifts their weight during a prolonged knee support position.

Figure 7:
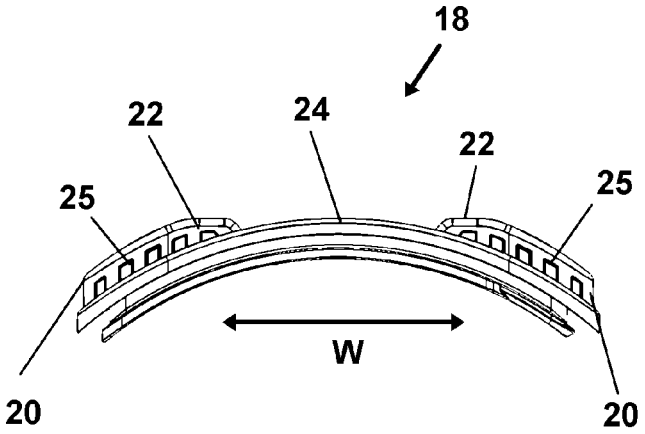
FIG. 7 shows a top view of a particularly preferred mode of the removably engageable stabilizing projection.

In at least one preferred mode as shown currently in FIG. 7, the means for shock absorbency is provided by forming the raised ends 20 on opposite sides of the recessed channel 24 therebetween, with a material and construction which is adapted for slight or moderate compression and rebound characteristics of the raised ends 20, when the weight of the user against the device 10 changes or increases, and which is communicated to the raised ends 20, much like a shock absorber.

For example, a resilient rubber or similar material, such as ABSORBATHANE, which will compress under the weight of the user against the support surface during movement and/or landing on the support surface, and will absorb impact and contact forces when the device contacts the ground are suitable for this purpose.

In addition, the raised ends 20 can be formed with a plurality of relief channels 25 between the first side used for mounting and the distal side opposite and communicating through the ends 20. This construction essentially configures the raised ends 20 to be more suitably adapted for slight or moderate compression and rebound characteristics when placed under the load of the user's weight.

Further, while shown communicating with a rear surface of the raised ends 20 opposite the contact surface 22, the relief channels 25 can also be formed to communicate through the contact surface 22 of the raised end 20 of the projections 18. With the channels 25 communicating to the contact surface 22, when the contact surface 22 is placed on a support surface, the channels 25 form somewhat of a suction cup enhancing resistance to sliding, which may be desirable in wet or slick surfaces. However, other embodiments envisioned by those skilled in the art, which serve the intended purpose of shock absorbency, may also be employed and are anticipated.

In addition, it is anticipated that the material selection of the projections 18 can be selected by the designer to provide means for slip resistance between the contact surfaces 22 of the device and the support surface. For example, the planar contact surfaces 22 curving around the projections 18 from the recessed channel 24 to the opposite end of the projection 18, may be constructed with a contact layer using a friction enhancing material, such as a "sticky" or soft rubber or the like.

Forming the projections 18 in such a manner can be accomplished by a two shot injection molding process which imbeds a high coefficient of friction material in a layer forming the contact surfaces 22 extending around each of the projections 18. Alternatively, the entire projection 18 can be formed of the friction enhanced material if deemed suitable by the manufacturer. However, other embodiments envisioned by those skilled in the art which serve the intended purpose of reducing slip may also be employed, and are anticipated.

FIGS. 8-9 show still another mode of the device 10 including a upper component 30 which is rotatably engaged to one end of the body 12 of the device 10. The upper component 30 preferably employs a rotational or pivoting engagement such as with a hinge 32 or other suitable rotational engagement means. When worn, the upper component 30 is adapted to contact the user's thigh, just above the knee, and is intended to provide support and shielding protection to the user's thigh when the user is working on their knees.

When working with various tools and hardware in a knee supported as-worn position, the user's work space is conventionally directly in an arc in front of the user and the thigh is conventionally exposed. Thus, the engagement of the upper component 30 to cover the thigh of the user will define a protective barrier and will further ensure the user's safety as needed. The rotatable engagement at the hinge 32 will allow the upper component 30 to articulate with the user's knee for walking, leaning, and other natural movements.

Additional utility is provided through the employment of a sealing strap 35 which is configured to engage at or near an upper terminating edge 33 of the upper component 30. In the as-used mode, the sealing strap 35 communicates over the upper terminating edge 33 of the upper component 30 to provide a sealed engagement of the upper component 30 against the user's thigh. This provides a means for prevention of the entry of sparks or slag in-between the upper component 30 and thigh during welding, or other debris from lodging between the upper component 30 and the user's thigh and is a vast improvement over prior art.

The upper component 30 and body 12 of the device 10 are preferably in a biased engagement against the knee and thigh of the user, via one or a plurality of engagement straps 34. The connection of the straps 34 to the body 12 and upper component 30 can be provided by operative strap slots 17, or through employment of a removable fastener 36 adapted to rotationally engage within the strap slots 17. The fastener 36 may include a tongue portion 38 which can be rotationally engaged into mating locking apertures 15 disposed on the side of the body 12 and upper component 30. However, those skilled in the art may envision any mating fastener configuration or other means for removable engagement for the intended purpose, and all such means for fastening are anticipated.

In FIG. 10 is shown a particularly preferred kit mode 40 of the device 10. In this kit 40, the body 12 is configured with means for removable engagement of the stabilizing projections 18 and the pad component 28 as needed to facilitate replacement after they become worn and unusable. As such, the kit 40 preferably includes at least one body 12, one or a plurality of removably engageable pad components 28, one or a plurality of sets of removably engageable stabilizing projections 18, at least one upper component 30, one or a plurality of straps 34, and one or a plurality of strap fasteners 36. The plurality of sets of the stabilizing projections 18 and pad components 28 provided in the kit 40 may be formed of different durometer or hardness materials which provide different friction enhancing and shock absorbency characteristics, and comfort level, respectively, for selective engagement by the user as deemed suitable for the intended purpose. In addition, the dimensions of the projections 18, especially the distance of the channel 24 between adjacent raised ends 20, can be varied to allow the user to select the desired configuration, which achieves a contact footprint area which is customizable to their needs.

Those skilled in the art may envision modifications to the kit 40 which may include different suitable combinations of the various components of the invention, and are anticipated. For example, a kit may be provided having only a plurality of different sets of projections 18 which can be provided, separately from the body 12, as needed for replacement.

Figure 11:
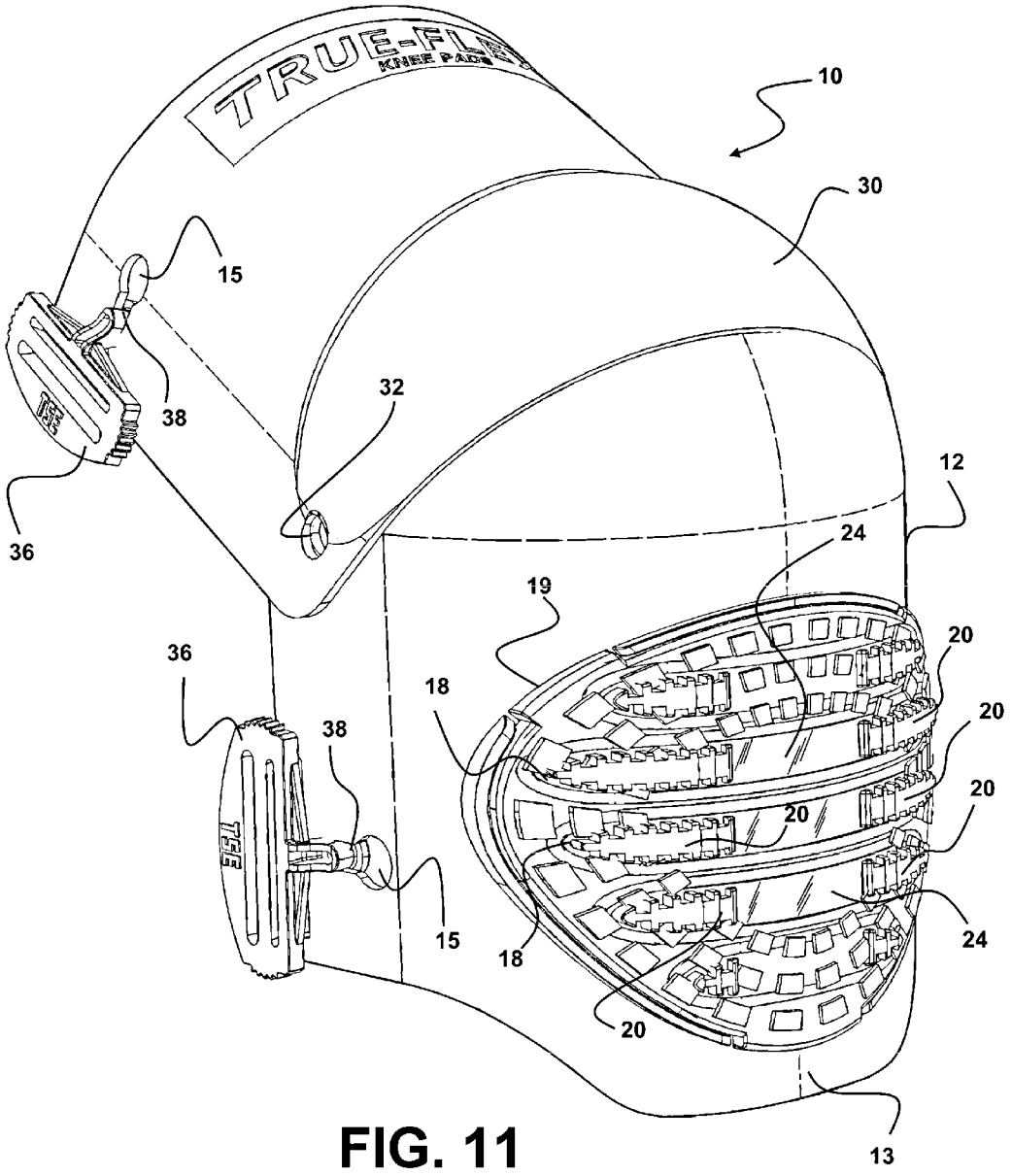
FIG. 11 shows the device herein with the body and upper component rotationally engaged as in FIGS. 8-9, and depicts the projections positioned on a projection body which engages with the body.

Shown in FIG. 11, is the device 10 herein with the body 12 and upper component 30 rotationally engaged about a pivot or hinge pin 32 as in FIGS. 8-9, showing the projections 18 positioned on a projection body 19. As noted above, in this mode of the device 10, the plurality of projections 18 may be formed by a single unit or unitary structure where the projection body 19 has a plurality of projections 18 having channels 24 recessed between opposing raised ends 20. The projection body 19 is preferably formed with connectors to removably engage with the body 12 to allow easy replacement of the projections 18 by replacement of the projection body 19 in a single unit.

Figure 12:
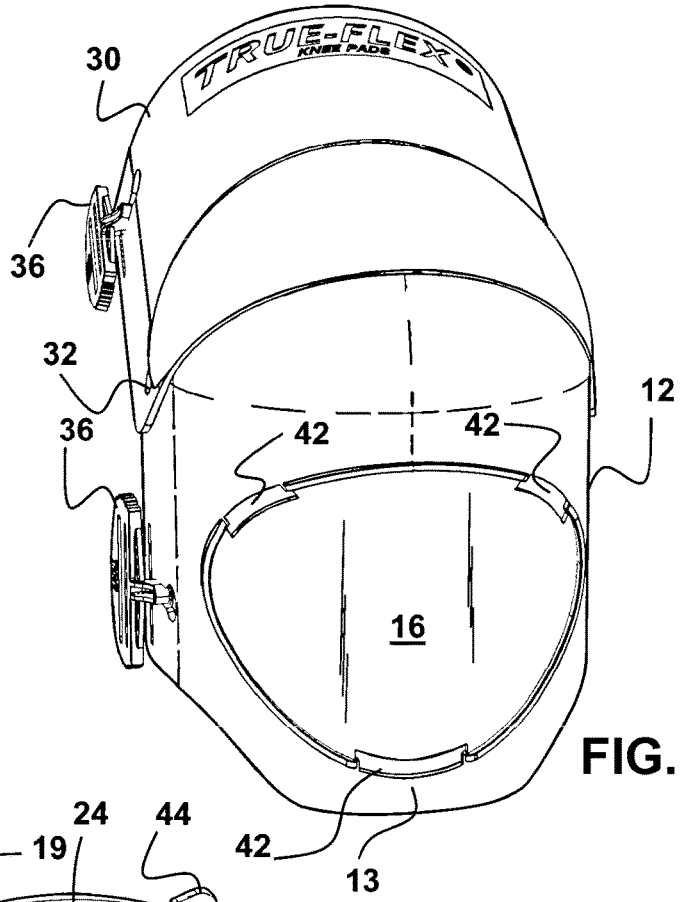
FIG. 12 shows the device as in FIG. 11 and depicts a plurality of tab apertures providing connectors for a removable engagement to tab apertures in the body to form a removable engagement of a projection body such as in FIG. 13-16 with the body of the device.

In FIG. 12 is depicted the device 10 showing tab apertures 42 formed into the body 12 and communicating therethrough with the exterior surface 16 of the body 12. These tab apertures 42 are configured to removable engage with tabs 44 shown in FIGS. 13-16 which extend to distal ends of the tabs 44 from first ends engaged with the projection body 19. As shown, a plurality of tabs 44 extending from each projection body 19, are positioned to engage respective tab apertures 42 formed into the body 12 of the device 10, and thereby engage the projection body 19 such as in FIGS. 13-16 to the body 12 of the device 10.

The connection of the tabs 44 with respective tab apertures 42 thereby forms a plurality of individual removably engageable connectors to hold the projection body 19 such as in FIGS. 13-16, secure on the exterior surface 16 of the body 12 of the device 10. Of course other removable engageable connectors may be employed for example hook and loop fabric, adhesive, screws, bolts, or other removable engageable connectors as would occur to those skilled in the art such as those fasteners found in the GRANGER catalog.

Figure 13:
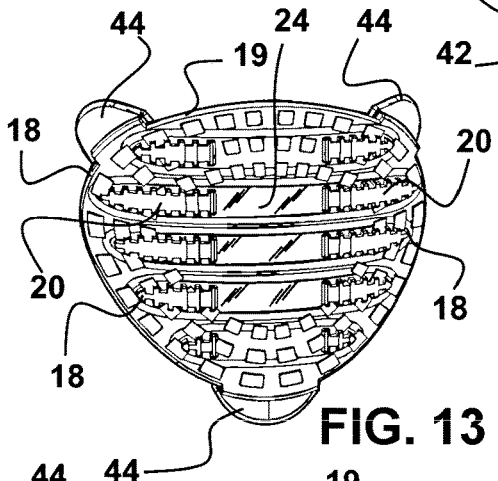
FIG. 13 shows the projections having raised ends on either side of a recessed channel formed in a unitary structure with the projection body which has a connector for removable engagement with the body formed by tabs on the projection body engageable in tab apertures in the body.
Figure 14:
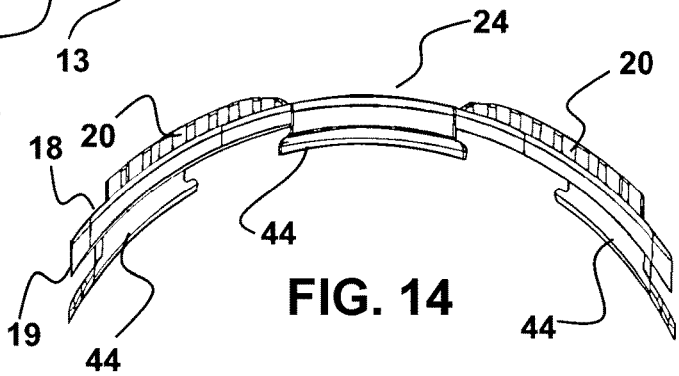
FIG. 14 is a side view of the projection body of FIG. 13.

FIGS. 13-14 show views of the projection body 19 such as that engaged to the body 12 in FIG. 11, showing the plurality of projections 18 having raised ends 20 on opposite sides of a respective recessed channel 24. As noted, the projections 18 are formed in a unitary structure with the projection body 19 and have recessed channels 24 located in-between raised ends 20 which have contact surfaces 22 thereon. Formation in a unitary structure allows for quick replacement of all of the projections 18 when needed.

Figure 15:
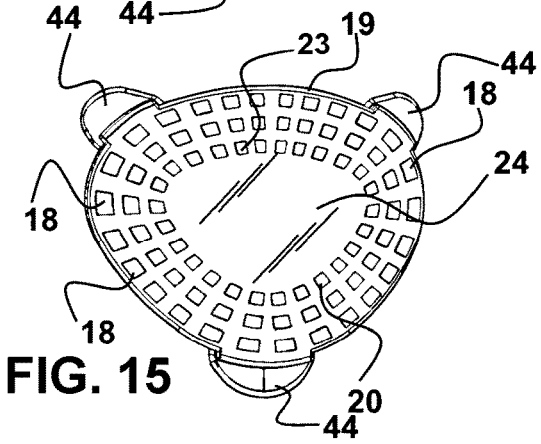
FIG. 15 depicts a projection body having a centrally Positioned channel which is radially surrounded on a perimeter of the channel by a plurality of raised projections extending toward a perimeter edge of the projection body.
Figure 16:
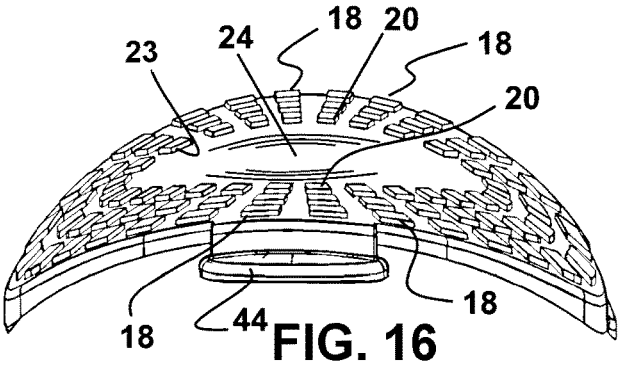
FIG. 16 shows the projection body of FIG. 15 from a side view.

In FIGS. 15-16 is depicted the projection body 19 having a channel 24 forming the recessed area which is surrounded on opposite sides thereof, by a plurality of projections 18 which in this mode are formed by aligned raised portions 23 radially positioned around the channel 24. The aligned raised portions 23 form a plurality of projections 18 on opposite sides of the channel 24, which radially surround the channel 24. This pattern has been found in experimentation to support the body 12 and the user engaged therewith, and prevent tipping of the body 12 in a direction aligned with the axis of the thigh of the user wearing the device 10 along with preventing roll and tipping to the opposing sides.

Figure 6:
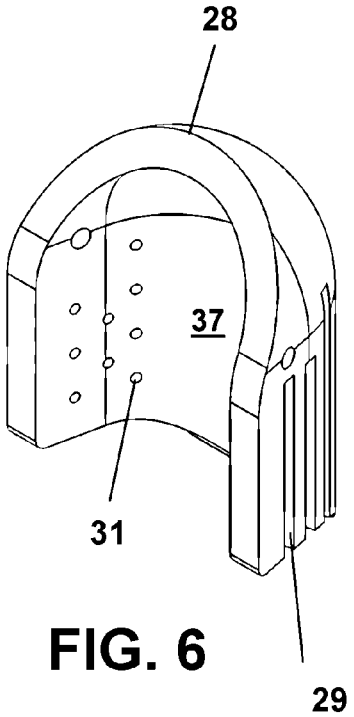
FIG. 6 shows a rear perspective view of the padding component of the mode of the device of FIG. 5, detailing the air vent channels and vent apertures employed as a air cooling means.

FIG. 17 depicts the device 10 of FIG. 5 or 11-12 where the cavity 11 formed by the curved interior surface 14 of the body 12 to and along the side portions 21 is adapted to engage a pad component 28 similar to that of FIGS. 5-6, but where the pad component 28 is formed of foam material of dual density. A first density foam area 46 having a softer more compressible foam or other material is located in a central portion in-between opposing sidewalls 47 formed of a second density material which is harder or less compressible than that of the first density foam.

In experimentation, such was found to provide the user better stability and preventing leaning to the side by using the harder foam on opposing sides of the softer material, which helps pad the knees from contact against the body 12 when kneeling. Currently the softer first foam density is of a shore between 10-40 with a shore of substantially 25 being particularly preferred. The second foam density is between 30 to 60 shore, with a shore of substantially 45 being particularly preferred. By substantially is meant plus or minus 5 shore.

Figure 18:
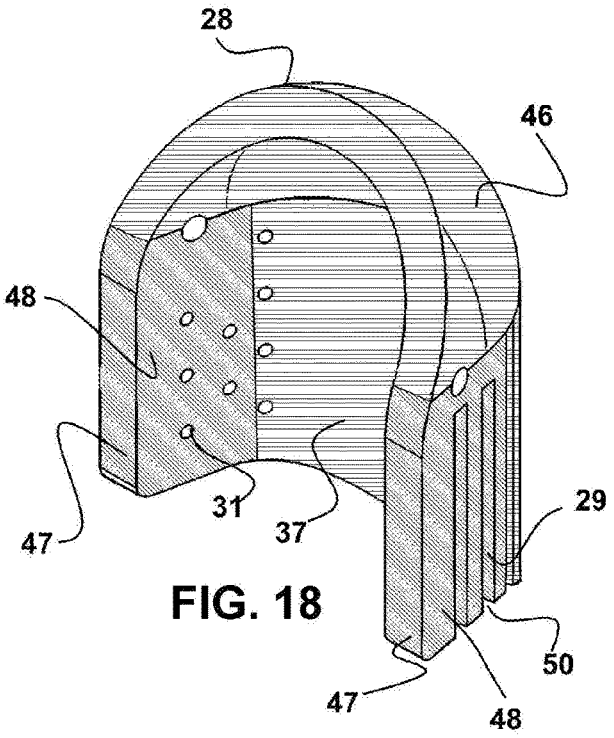
FIG. 18 is a rear view of the dual density pad component of FIG. 17.

In FIG. 18 is shown a rear view of the pad component 28 of FIG. 17, showing the curved interior surface 37 of the pad component 28. As can be seen and as described above with regard to the pad component 28 of FIGS. 5-6, vent apertures 31 communicate through the body of the pad component 28 which vent channels 29 showing in FIG. 17 which depend into the exterior surface 27 of the pad component 28. The vent apertures 31 allow air passage through the pad component 28 and to the interior surface 37 and knee therein. The vent channels 29 are preferred because they provide a passage for air to communicate to the vent apertures 31 through the open ends 50 of the recessed channels 24 which in experimentation was found to significantly increase the flow of air through the vent apertures 31 to help cool the knee of the user, from a design which simply had the vent apertures 31 without the vent channels 29.

This invention has other applications, potentially, and one skilled in the art could discover these. The explication of the features of this invention does not limit the claims of this application; other applications developed by those skilled in the art will be included in this invention.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A knee pad apparatus, comprising:

a body having a central portion positioned in between two opposing side portions of said body;

said body having a curved exterior surface extending across said central portion;

said body having a cavity defined by a curved interior surface extending across said central portion and said opposing side portions, said cavity positioned on an opposite side from said exterior surface;

said cavity for positioning of a knee of a user therein to an as-worn position of said knee pad, with said user kneeling upon said curved interior surface and having said side portions positioned on opposing sides of said knee;

a projection body in an engagement to said central portion of said body;

a first plurality of elongated projections positioned on said projection body;

a second plurality of elongated projections positioned on said projection body;

said first plurality of elongated projections each having a first raised end abutting a first side of a recessed channel area, and each of said first plurality of elongated projections extending away from said first raised end thereof, toward a first one of said opposing side portions, to a second raised end thereof;

each of said second plurality of elongated projections having a first raised end thereof abutting a second side of said recessed channel area opposite said first side thereof, each of said second plurality of elongated projections extending away from said first raised end thereof, toward a second one of said opposing side portions to a second raised end thereof;

contact of said recessed channel area upon a support surface along with each said first plurality of elongated projections, and said second plurality of elongated projections, on opposite sides of said recessed channel area, forms a non-rolling support for said curved exterior surface of said kneepad upon said support surface during use in said as-worn position, said non-rolling contact preventing rolling of said body in a direction toward either of said side portions.

2. The knee pad apparatus of claim 1, additionally comprising:

said first plurality of elongated projections abutting said first side of said recessed channel area, being aligned with said second plurality of elongated projections positioned on said projection body abutting said second side of said recessed channel area.

3. The knee pad apparatus of claim 1, additionally comprising:

said projection body having a perimeter edge;

said recessed channel area located in a central area of said projection body in-between opposing sides of said perimeter edge and;

said second raised ends of said first plurality of elongated projections and said second plurality of elongated projections extending toward said perimeter edge of said projection body radially around said recessed channel area.

4. The knee pad apparatus of claim 3 wherein said engagement of said projection body with said central portion of said body, is a removable engagement between tabs extending from said perimeter edge of said projection body and tab apertures located in said curved exterior surface.

5. The knee pad apparatus of claim 1 additionally comprising:

a pad component having an exterior surface configured to engage with said interior surface of said cavity; and said pad component having an interior surface opposite said exterior surface for a surrounding contact with said knee of said user.

6. The knee pad apparatus of claim 5 additionally comprising:

vent channels depending into said exterior surface of said pad component; and vent apertures communicating between said interior surface and said vent channels, whereby air is communicable through said vent channels to said interior surface of said pad component.

7. The knee pad apparatus of claim 5 additionally comprising:

said pad component having a central pad portion extending to opposing sidewall pad portions on opposite sides of said central pad portion;

said central pad portion formed of foam material having a first density of substantially 25 shore; and said sidewall pad portions formed of a foam material having a second density of substantially 45 shore.

* * * * *